US005496515A

United States Patent [19]

Pedarre et al.

[11] Patent Number: 5,496,515

[45] Date of Patent: Mar. 5, 1996

[54] FERRITIC STAINLESS STEEL WITH IMPROVED MACHINABILITY

[75] Inventors: Pierre Pedarre, Annecy; Pascal Terrien, Albertville, both of France

[73] Assignee: Ugine Savoie (Societe Anonyme), Ugine Cedex, France

[21] Appl. No.: 420,484

[22] Filed: Apr. 12, 1995

[30] Foreign Application Priority Data

May 31, 1994 [FR] France ..... 94 06590

[51] Int. Cl.[6] ..... C22C 38/18; C22C 38/60

[52] U.S. Cl. ..... 420/41; 420/42

[58] Field of Search ..... 420/41, 42; 148/325

[56] References Cited

U.S. PATENT DOCUMENTS 4,969,963 11/1990 Honkura et al. ..... 420/41
5,089,224 2/1992 Bletton et al. ..... 420/41
5,362,439 11/1994 Bletton et al. ..... 420/41
5,427,635 6/1995 Bletton et al. ..... 420/41

*Primary Examiner*—Deborah Yee
*Attorney, Agent, or Firm*—Sixbey, Friedman, Leedom & Ferguson

[57] ABSTRACT

Ferritic stainless steel with improved machinability, which can be used especially in the field of screw machining, characterized by the following composition:

C<0.17%
Si<2.0%
Mn<2.0%
Cr[11–20] %
Ni<1.0%
S≦0.55%
Ca>30×10$^{-4}$%
O>70×10$^{-4}$% the Ca/O ratio, between the calcium content and the oxygen content, being given by 0.2<Ca/O<0.6, the said steel being subjected, after rolling and cooling, to an annealing heat treatment giving it a ferritic structure.

8 Claims, 8 Drawing Sheets

FERRITIC STAINLESS STEEL WITH IMPROVED MACHINABILITY

FIELD OF THE INVENTION

The present invention relates to a stainless steel of ferritic structure and with improved machinability, which can be used especially in the field of screw-machining.

By stainless steels are meant iron alloys containing at least 10.5% of chromium.

Other elements enter into the composition of steels so as to modify their structure and their properties. Four standard families of stainless steels are known which are differentiated by their structure. These are:

stainless steels of martensitic structure, stainless steels of austenitic structure, stainless steels of austeno-ferritic structure, stainless steels of ferritic structure.

Ferritic stainless steels are characterized by a defined composition, the ferritic structure being especially provided, after rolling and cooling the composition, by an annealing heat treatment giving them the said structure.

Among the four large families of ferritic stainless steels, defined especially as a function of their chromium content and carbon content, we mention:

ferritic stainless steels which may contain up to 0.17% of carbon. These steels, after the cooling that follows their manufacture, have an austeno-ferritic two-phase structure. They are converted into ferritic stainless steels after annealing, despite a relatively high carbon content.

ferritic stainless steels, the chromium content of which varies from 11 to 12%. They are quite close to the martensitic steels containing 12% of chromium, but differ from them by their carbon content which is markedly lower.

For example, the following table gives a series of ferritic and martensitic steels with the carbon content dictated by the Standard.

| | Grade | Content dictated by the Standard |
|---|---|---|
| FERRITIC STEELS | AISI 430 (Z 8 C 17) | C < 0.12% |
| | AISI 434 (Z8CD17-01) | C < 0.12% |
| | AISI 430 F (Z10 CF 17) | C < 0.12% |
| MAR-TENSITIC STEELS | AISI 420 A (Z 20 C 13) | 0.15% < C < 0.24% |
| | AISI 416 (Z 12 CF 13) | 0.08% < C < 0.15% |

ferritic stainless steels having 17% of chromium. These are the most common. Many variants of them exist in particular as regards the carbon content. Adding molybdenum makes it possible to improve their corrosion resistance.

In general, the ferritic structure of steels is preferably obtained by limiting the quantity of chromium carbide, and it is for this reason that most ferritic stainless steels have a carbon content less than 0.12%, or even 0.08%.

ferritic stainless steels with 17% of chromium, stabilized by adding elements having a high affinity for carbon or nitrogen, such as titanium, niobium and zirconium.

ferritic stainless steels having a high chromium content, generally greater than 24%.

From the metallurgical standpoint, it is known that certain elements contained in the steel composition promote the appearance of the ferritic phase which has a body-centred-cubic structure. These elements are called alpha-forming elements. Numbered among them are chromium and molybdenum. Other elements, called gamma-forming elements, favour the appearance of the gamma austenitic phase which has a face-centred-cubic structure. Numbered among these elements are nickel as well as carbon and nitrogen.

When steels are hot-rolled, the structure of the steel may be a two-phase, ferritic and austenitic structure. If cooling is rapid, for example, the final structure is ferritic and martensitic. If it is slower, the austenite decomposes partially into ferrite and carbides, but with a carbide content richer than the surrounding matrix, the austenite having dissolved, when hot, more carbon than the ferrite. In both cases, the hot-rolled and cooled steels must be tempered or annealed in order to generate a completely ferritic structure. Tempering may be performed at a temperature of approximately 820° C., below the alpha - gamma transition temperature A1 which causes carbide precipitation.

It is also possible to carry out an anneal at a higher temperature, for example 870° C., which leads to a more marked softening of the martensite but causes partial transformation into austenite. A slow cool is then necessary to decompose the austenite formed into ferrite and carbides, thus preventing the formation of new martensite.

In the manufacture of so-called stabilized ferritic steels, the carbon combines with the stabilizing elements such as titanium and/or niobium, and no longer participates in the formation of gamma-forming phase, no longer being present in the matrix. In this case, it is possible to obtain, after hot rolling, a steel whose structure is completely ferritic.

From the standpoint of the physical properties, the most obvious difference between ferritic steels and austenitic steels is the ferromagnetic behavior of the former.

The thermal conductivity of ferritic steels is very low. It lies between that of martensitic steels and that of austenitic steels at room temperature. It is equivalent to the thermal conductivity of austenitic steels at temperatures between 800° C. and 1000° C., which temperatures correspond to the temperatures of steels during machining.

From the machining standpoint, the coefficient of thermal expansion of ferritic steels is approximately 60% higher than that of austenitic steels.

Furthermore, ferritic steels have mechanical properties distinctly inferior to those of martensitic and austenitic steels.

In one example, the table below gives a series of ferritic, martensitic and austenitic stainless steels and the corresponding mechanical properties ($R_m$).

| | Stainless steel | Normed $R_m$ (MPa) |
|---|---|---|
| Ferritic | AISI 430 (Z8 C17) | 440–640 |
| | AISI 430F (Z20 CF 17) | 440–640 |
| Martensitic | AISI 420A (Z20 C13) | 700–850 |
| | AISI 420B (Z33 C13) | 850–1000 |
| | F162PH(Z7CNU16-04) (quenched) | 930–1100 |
| Austenitic | AISI304(Z6CNT1810) | 510–710 |

In the manufacture of steels which have ferritic structures, the yield stresses at rolling temperatures are markedly lower than those for austenitic steels or for martensitic steels. Consequently, rolling is carried out at relatively low temperatures.

By way of indicative example, the yield stress at a rolling temperature of 1100° C. and for a deformation rate of 1 $s^{-1}$ is 110 MPa for a martensitic steel of AISI 420 A type and 130

MPa for an austenitic steel of the AISI 304 type, whereas it is 30 MPa for a ferritic steel of the AISI 430 type.

Steels which have a ferritic structure are not subjected to rapid cooling of the quench cooling or hyperquenching type, as are martensitic or austenitic steels. On the other hand, they are generally subjected to well specified off-line heat treatments which give them their structure. The purpose of the off-line heat treatments is also to render the chromium element homogeneous and to prevent the creation of chromium carbide and the appearance of chromium-depleted zones.

For example, nonstabilized 17%-chromium steels of ferritic structure have, after rolling, a ferritic and martensitic structure. Heat treatment transforms the martensite into ferrite and into carbides on the one hand, and uniformly distributes the chromium on the other hand.

In the field of their application, ferritic stainless steels pose machinability problems which are very different from those encountered with stainless steels of austenitic or martensitic structure.

Indeed, a major drawback of ferritic steels is the poor shaping of the chip. They produce long and entangled chips which are very difficult to fragment. It is thus necessary for operators to remain close to the machine in order to clear the tools. This drawback may result in a high cost penalty in modes of machining where the chip is confined, for example in deep hole drilling or parting off.

PRIOR ART

One solution for solving this problem is to machine at a high cutting speed in order to fragment the chip, but, on the one hand, the increase: in the cutting speed critically reduces the lifetime of the tools and, on the other hand, the machines do not always allow sufficiently high speeds to be reached, in particular when producing small-diameter parts, especially in screw-machining.

Another solution used to alleviate the problems of machining ferritic steels is to introduce sulfur into their composition. Sulfur forms, with manganese, manganese sulphides which have a favorable effect on the fragmentation of the chips and, secondarily, on the lifetime of the tools. However, sulfur degrades the properties of ferritic steel, especially the hot- and cold-deformability and the corrosion resistance.

The said ferritic steels usually contain hard inclusions of the chromite (Cr Mn, A1 Ti)O, alumina (A1Mg)O or silicate (SiMn)O type which are abrasive for cutting tools.

It has been shown that resulfurized ferritic steels have good machinability, however, in addition to the corrosion resistance, the mechanical properties in the transverse direction are greatly inferior.

The object of the invention is to provide a ferritic steel with improved machinability, having properties markedly superior to those, for example, of resulfurized ferritic steels and, in another form, to provide a machinable ferritic steel containing no or little sulfur.

SUMMARY OF THE INVENTION

The subject of the invention is a stainless steel of ferritic structure and having improved machinability, which can be used especially in the field of screw-machining and which comprises in its composition:

carbon≦0.17%
silicon≦2%
manganese≦2%
chromium: [11–20] %
nickel<1%
sulfur≦0.55%
calcium≧$30\times10^{-4}$%
oxygen≧$70\times10^{-4}$% the Ca/O ratio, of the calcium content to the oxygen content, being given by 0.2≦Ca/O≦0.6.

Preferably, the stainless steel of ferritic structure comprises, in its composition:

carbon≦0.12%
silicon≦2%
manganese≦2%
chromium [15–19] %
nickel<1%
sulfur≦0.55%
calcium≧$35\times10^{-4}$%
oxygen≧$70\times10^{-4}$% a Ca/O ratio, of the calcium content to the oxygen content, lying in the range 0.35≦ Ca/O≦0.6.

In one form of the invention:

the stainless steel of ferritic structure comprises, in its composition:

C≦0.08%
Si≦2.0%
Mn≦2.0%
Cr [15–19] %
Ni<1%
S ≦0.55%
Ca≧$35\times10^{-4}$%
O≧$70\times10^{-4}$% the Ca/O ratio between the calcium content and the oxygen content satisfying the relationship 0.35≦ Ca/O≦0.6.

The other characteristics of the invention are:

the ferritic steel includes from 0.15% to 0.45% of sulfur.

In another form of the invention:

the ferritic steel includes less than 0.035% of sulfur, the ferritic steel includes from 0.05 to 0.15% of sulfur, the ferritic steel may contain, in its composition, less than 3% of molybdenum.

BRIEF DESCRIPTION OF THE DRAWINGS

The following description and the appended drawings, all given by way of nonlimiting example, will make the invention understood.

Within the field of the machinability of stainless steels in general and as a function of the various structures of the steels used, the problems encountered turn out not only to be different, but also particularly specific. The problems encountered when machining ferritic steels have no connection with the problems encountered when machining austenitic or martensitic steels.

For example, austenitic stainless steels have the drawback of being work-hardened and of very rapidly wearing the cutting tools, the shape of the chips being poor, but without comparison with that of ferritic steels.

Figure 1:
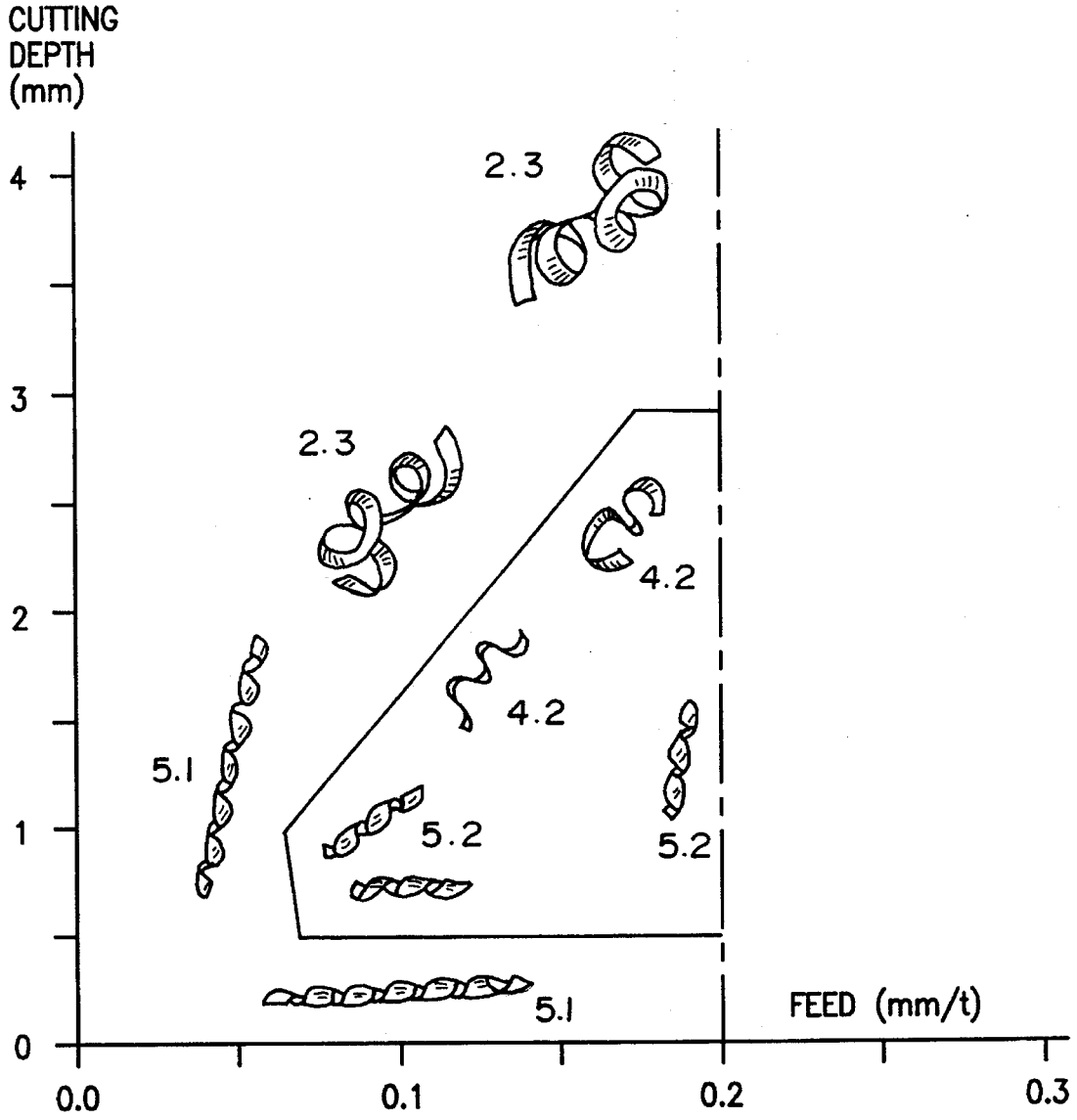
FIGS. 1 and 2 represent a diagram showing the shape of the chips as a function of the machining conditions, respectively for a known nonresulfurized AISI 430 ferritic steel, designated by the reference A, and for an AISI 304 austenitic steel.
Figure 2:
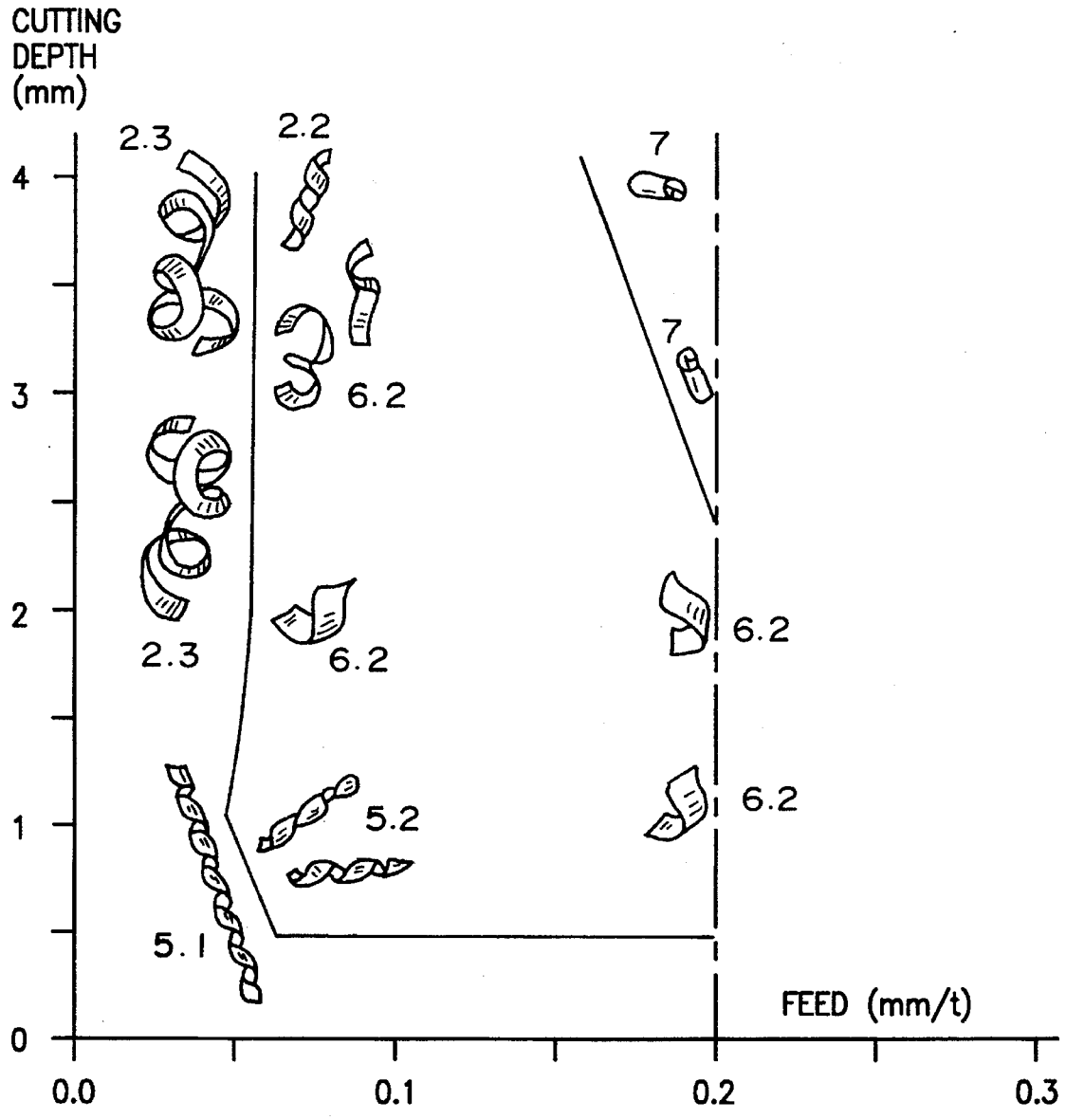

FIGS. 1 and 2 represent a diagram showing the shape of chips as a function of the feed and the machining cutting depth which are determined respectively for a nonresulfurized AISI 430 ferritic steel, corresponding to the reference A, and an AISI 304 austenitic steel.

Figure 3:
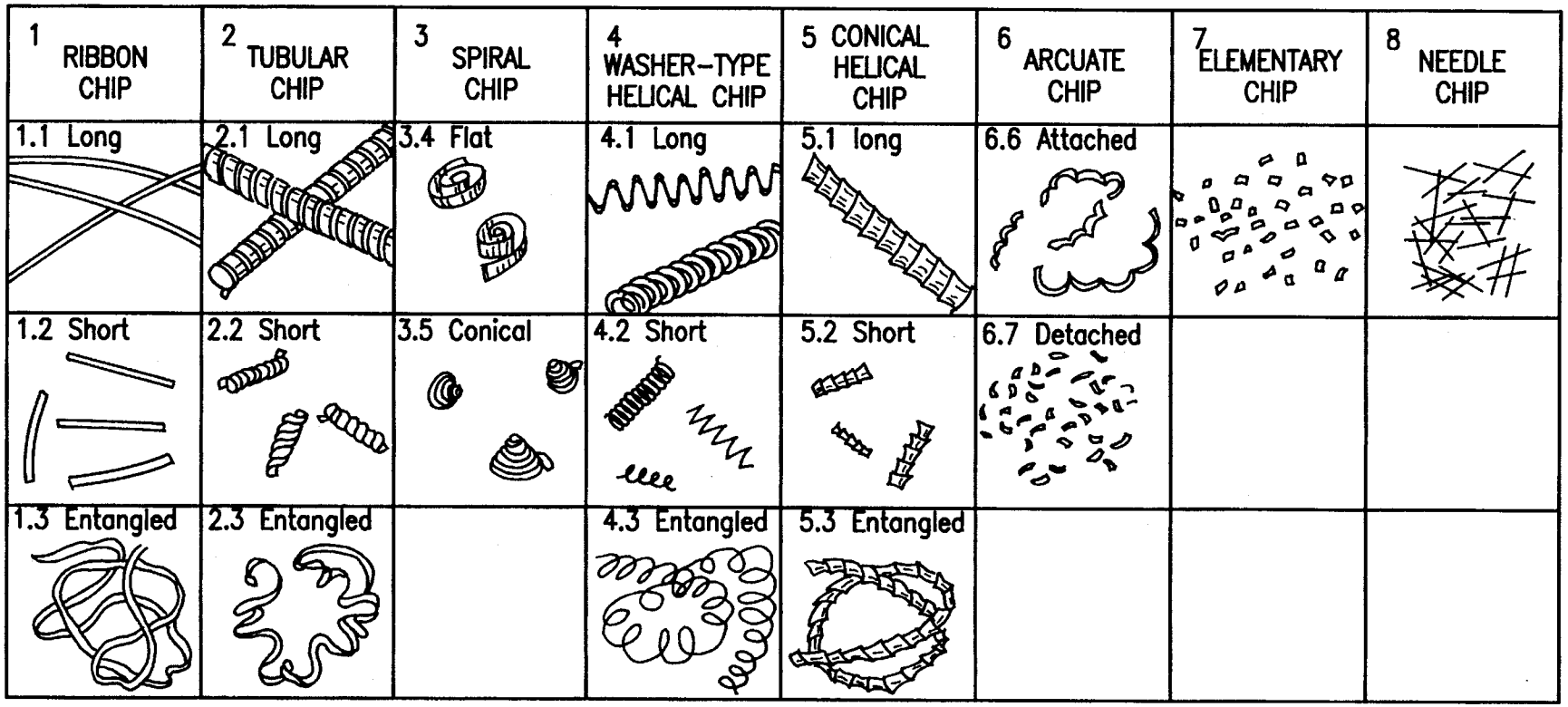
FIG. 3 represents various shapes of chips arising from machining when screw-machining various metals.

In order to be able to compare the shapes of chips, FIG. 3 is a table which associates with various shapes of chips a coefficient comprising several successive numbers, the first number defining various general pictures of the chip, forming the columns-of the table, such as 1: ribbon chip; 2 : tubular chip; 3: spiral chip; 4: washer-type helical chip; 5: conical helical chip; 6: arcuate chip; 7: elementary chip; 8: needle chip, the second number defining a size and shape characteristic classified in each of the columns, such as 1: long; 2: short; 3: entangled; 4: flat; 5: conical; 6: attached; 7: detached.

Martensitic stainless steels have high mechanical properties, generating high cutting temperatures and rapid tool wear.

Because of the low mechanical properties of stainless steels of ferritic structure, the said steels do not have the same modes of machining and of degradation of the cutting tools as those of martensitic steels.

Two types of ferritic stainless steel exist, depending on their sulfur content:

free-cutting steels which have a sulfur content lying between 0.15% and 0.55%. This type of steel, used in screw-machining, exhibits good machinability, but to the detriment of the corrosion resistance, standard steels which have a sulfur content of less than 0.035%. This type of steel exhibits good corrosion resistance, but it is not or hardly machined, really because of the difficulties encountered in screw-machining, steels having intermediate amounts of sulfur, corresponding to a content lying between 0.05% and 0.15%, are not commercialized. The reason for this is their machinability is only very moderately improved for these sulfur contents, compared to the so-called resulfurized steels. They offer no real advantage compared to the drawback, which still remains the degradation in corrosion resistance.

According to the invention, the ferritic stainless steel with improved machinability, which can be used especially in the screw-machining field, includes, in its composition by weight, less than 0.17% of carbon, less than 2% of silicon, less than 2% of manganese, from 11 to 20% of chromium, less than 1% of nickel, less than 0.55% of sulfur, more than $30\times10^{-4}$% of calcium and more than $70\times10^{-4}$% of oxygen, the steel being subjected, after processing, to an annealing treatment in order to give it a ferritic structure.

The presence of nickel in the composition due to the industrial processing of the steel is only a residual element which it is desired to reduce and even to eliminate.

Figure 4:
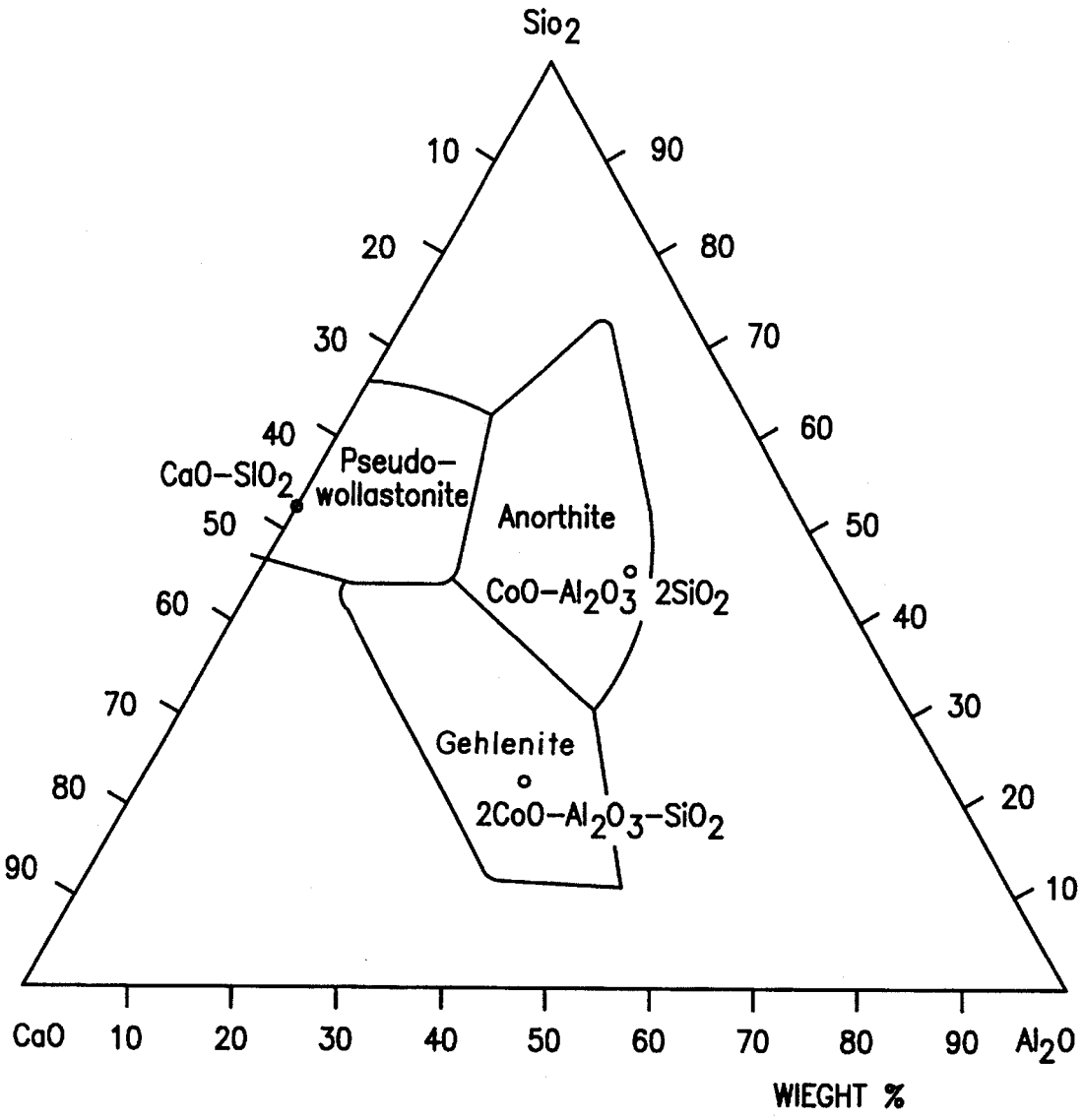
FIG. 4 is a ternary diagram defining the compositions of the malleable oxides introduced into the composition of the ferritic steel according to the invention.

The introduction, in a controlled and intentional manner, of calcium and oxygen at high contents satisfying the relationship $0.2 \leqq Ca/O \leqq 0.6$ promotes, in the ferritic steel, the formation of malleable oxides, chosen in an $Al_2O_3/SiO_2/CaO$ ternary diagram, within the zone of the anorthite/gehlenite/pseudo wollastonite triple point, as depicted in FIG. 4.

The presence of calcium and oxygen consequently reduces the formation of hard and abrasive inclusions of the chromite, alumina and silicate type.

It has been found that the introduction of oxides based on calcium and oxygen into a steel of ferritic structure, replacing existing hard oxides, in no way alters the other properties of the ferritic steel with regard to the hot- or cold-deformation or even to the corrosion resistance.

Although resulfurized ferritic steels have good machinability, chip fragmentation being provided by the presence of sulfur in the composition of the said steel, surprisingly the introduction of malleable oxides into the structure of the steel further improves, spectacularly, the machinability.

The so-called malleable inclusions contained in the likewise malleable steel cannot have the same behavior as malleable inclusions in a nonmalleable steel of austenitic or martensitic structure.

The reason for this is that the rolling temperatures for ferritic steels are less than the rolling temperatures for steels of another structure and the yield stress of the ferritic steels remains very low at these rolling temperatures.

It is really unexpected, because of the low value of the yield stresses, that the so-called malleable oxides are able to be deformed in order to influence the shape and behavior of the chip when machining.

Figure 5:
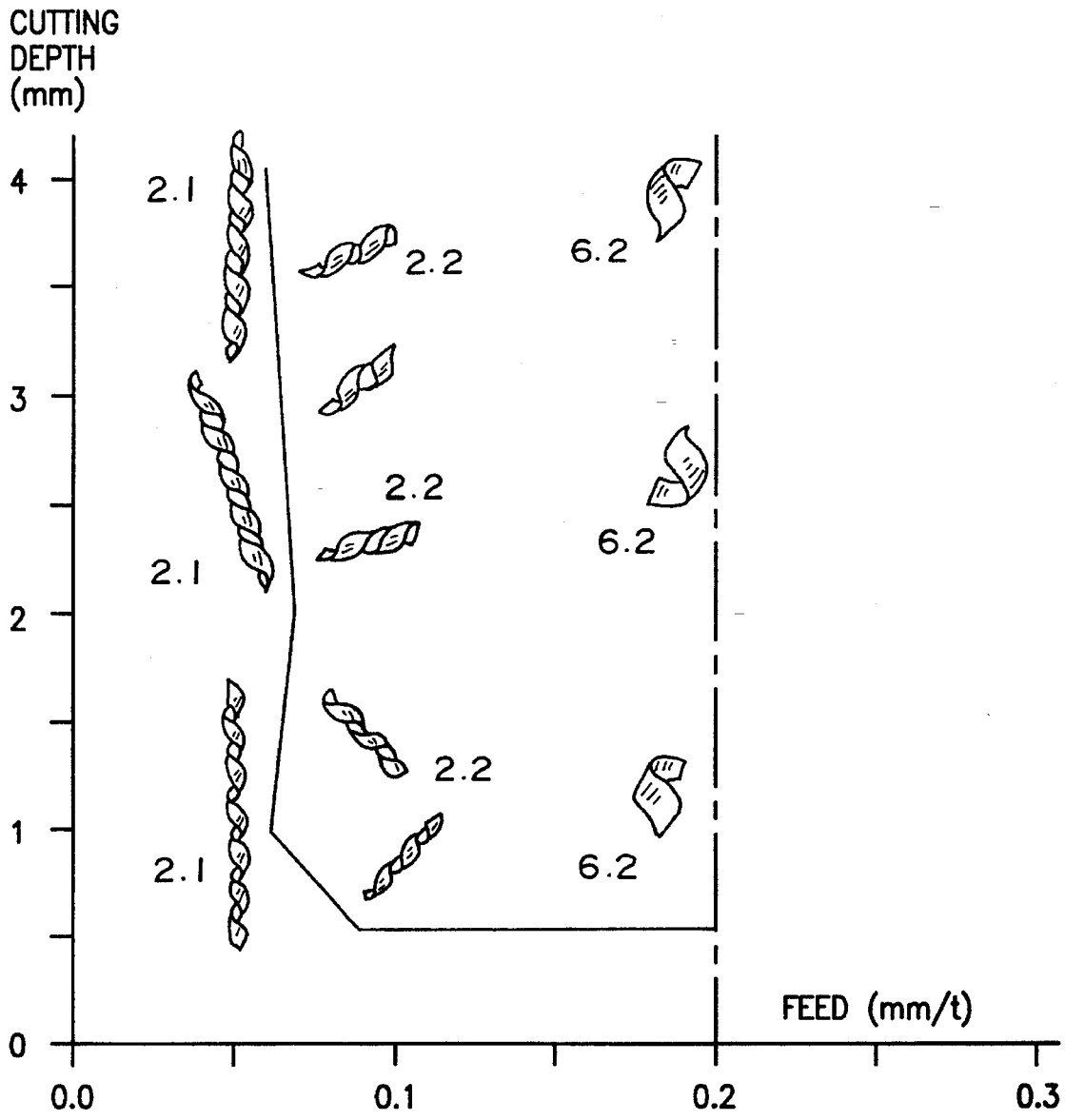
FIGS. 5 and 6 represent a diagram showing the shape of chips as a function of the machining conditions, respectively for a known AISI 430F ferritic steel C and for a resulfurized ferritic steel S according to the invention.
Figure 6:
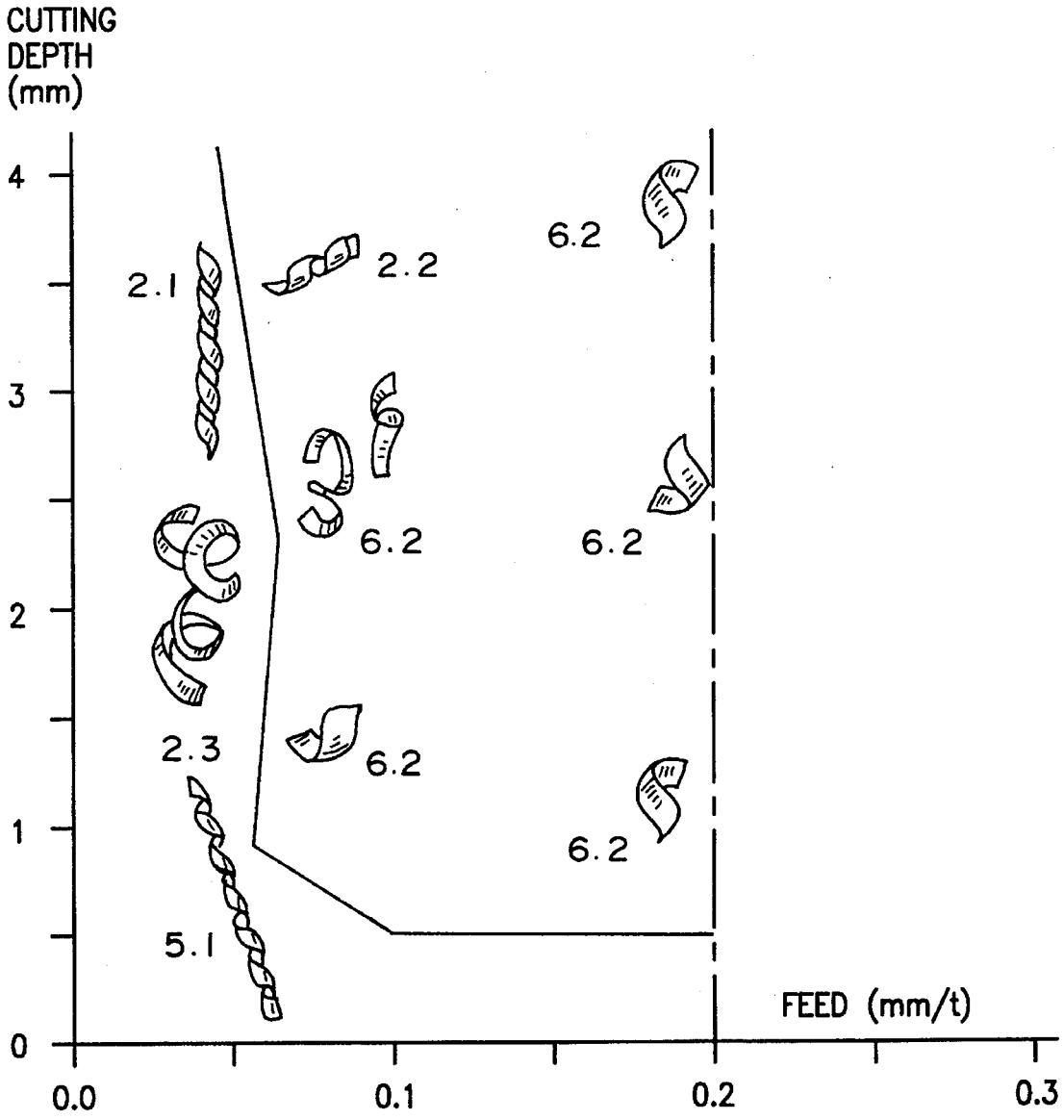

FIGS. 5 and 6 depict a diagram showing the shape of chips as a function of tool feed and machining cutting depth determined, respectively for a steel referenced C, of the resulfurized AISI 430F type, and for a resulfurized steel S according to the invention. The composition of the reference steel C is given in Table 1.

TABLE 1

| Steel | C | Si | Mn | Ni | Cr |
|---|---|---|---|---|---|
| Ref. C | 0.062 | 0.505 | 0.680 | 0.273 | 16.1 |
| Steel | Mo | Cu | S | P | $N_2$ |
| Ref. C | 0.214 | 0.091 | 0.298 | 0.022 | 0.037 |

The composition of the steel S according to the invention is given in Table 2.

TABLE 2

| Steel | C | Si | Mn | Ni | Cr | Mo | Cu |
|---|---|---|---|---|---|---|---|
| S | 0.059 | 0.523 | 0.610 | 0.323 | 16.1 | 0.221 | 0.151 |
| Steel | S | P | $N_2$ | Ca (ppm) | $O_2$ (ppm) | Ca/O | |
| S | 0.293 | 0.021 | 0.035 | 57 | 141 | 0.40 | |

For a steel according to the invention, the phenomenon of chip removal is very particular. Without being appreciably marked on the chip, the fragmentation is significantly increased.

Calcium and oxygen have also been introduced in a controlled manner into a ferritic steel having, in its composition, a sulfur content less than 0,035%.

The steels according to the invention may also contain less than 3% of molybdenum, an element improving the corrosion resistance. It is observed that a steel of ferritic structure according to the invention, containing no or very little sulfur, has greatly improved machining in such a way that this steel can be used industrially in screw-machining, while still exhibiting good corrosion resistance.

In one example of application, a machinability comparison is made between the nonresulfurized ferritic steel containing no oxide of the anorthite, galenite and pseudowollastonite type, reference A, and two steels C1 and C2 within the scope of the invention.

TABLE 3

| Steel | C | Si | Mn | Ni | Cr |
|---|---|---|---|---|---|
| Ref. A | 0.058 | 0.356 | 0.514 | 0.212 | 16.35 |
| **Steel** | **Mo** | **Cu** | **S** | **P** | **$N_2$** |
| Ref. A | 0.226 | 0.021 | 0.0114 | 0.019 | 0.046 |

TABLE 4

| Steel | C | Si | Mn | Ni | Cr | Mo | Cu |
|---|---|---|---|---|---|---|---|
| C1 | 0.059 | 0.380 | 0.461 | 0.153 | 16.53 | 0.229 | 0.022 |
| C2 | 0.066 | 0.523 | 0.487 | 0.205 | 16.19 | 0.241 | 0.021 |
| **Steel** | **S** | **P** | **$N_2$** | **Ca (ppm)** | **$O_2$ (ppm)** | **Ca/O** | |
| C1 | 0.0093 | 0.017 | 0.052 | 13 | 197 | 0.07 | |
| C2 | 0.0097 | 0.017 | 0.048 | 50 | 142 | 0.28 | |

Figure 7:
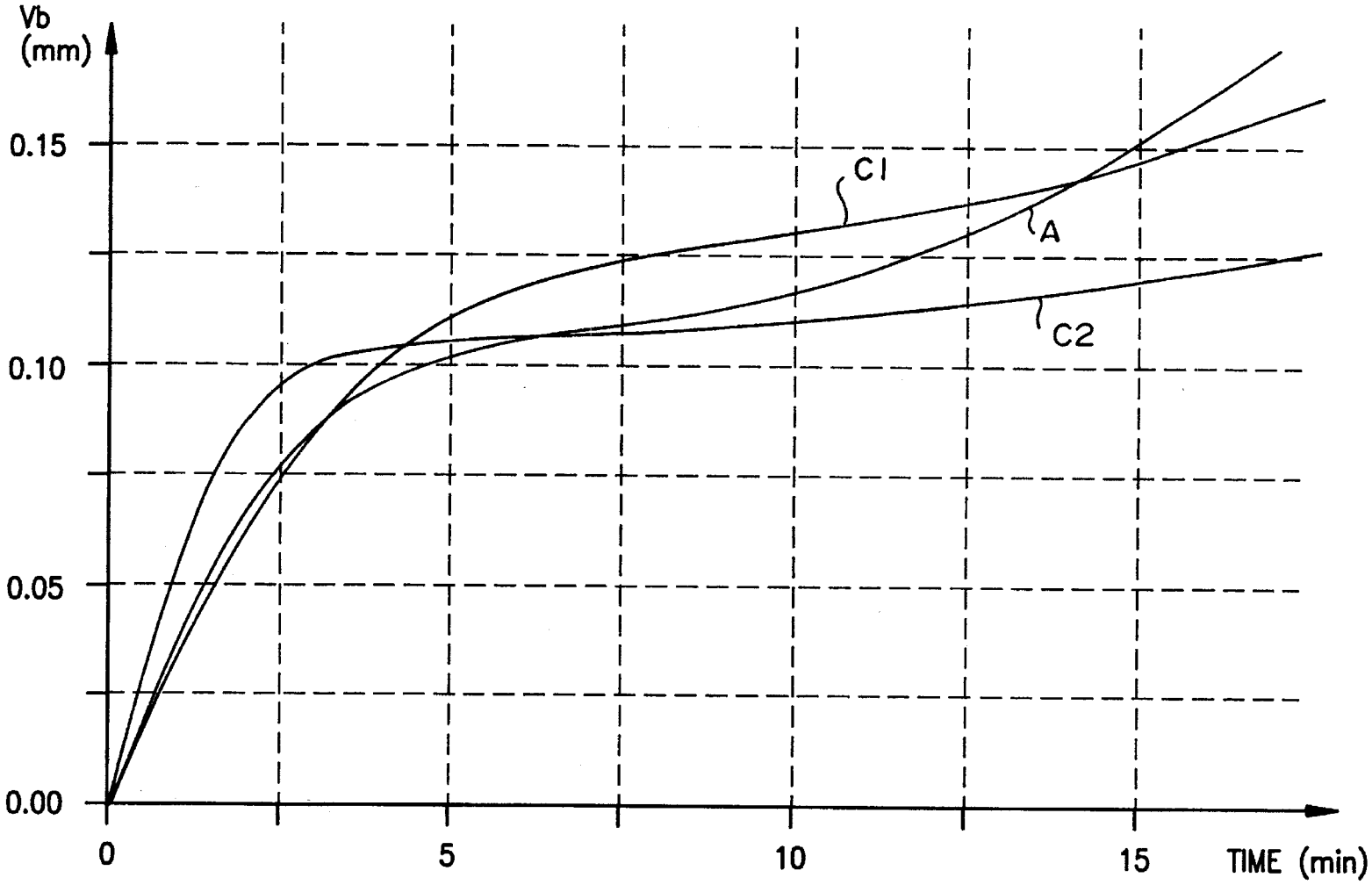
FIG. 7 is a diagram representing three characteristic test-of-machinability curves, one of which corresponds to the steel of reference A, the other two corresponding to two steels within the scope of the invention, C1 and C2, containing little sulfur.

In a machinability test, shown in FIG. 7, we observe, during the machining of the reference steel A, the steel C1 and the steel C2, the various rates of wear of a coated carbide tool. The test is carried out without lubrication so as to be more severe. We observe a decrease in the flank wear of the tool when we compare the reference steel A (curve A), the steel C1 (curve C1) and the steel C2 (curve C2) according to the invention.

Figure 8:
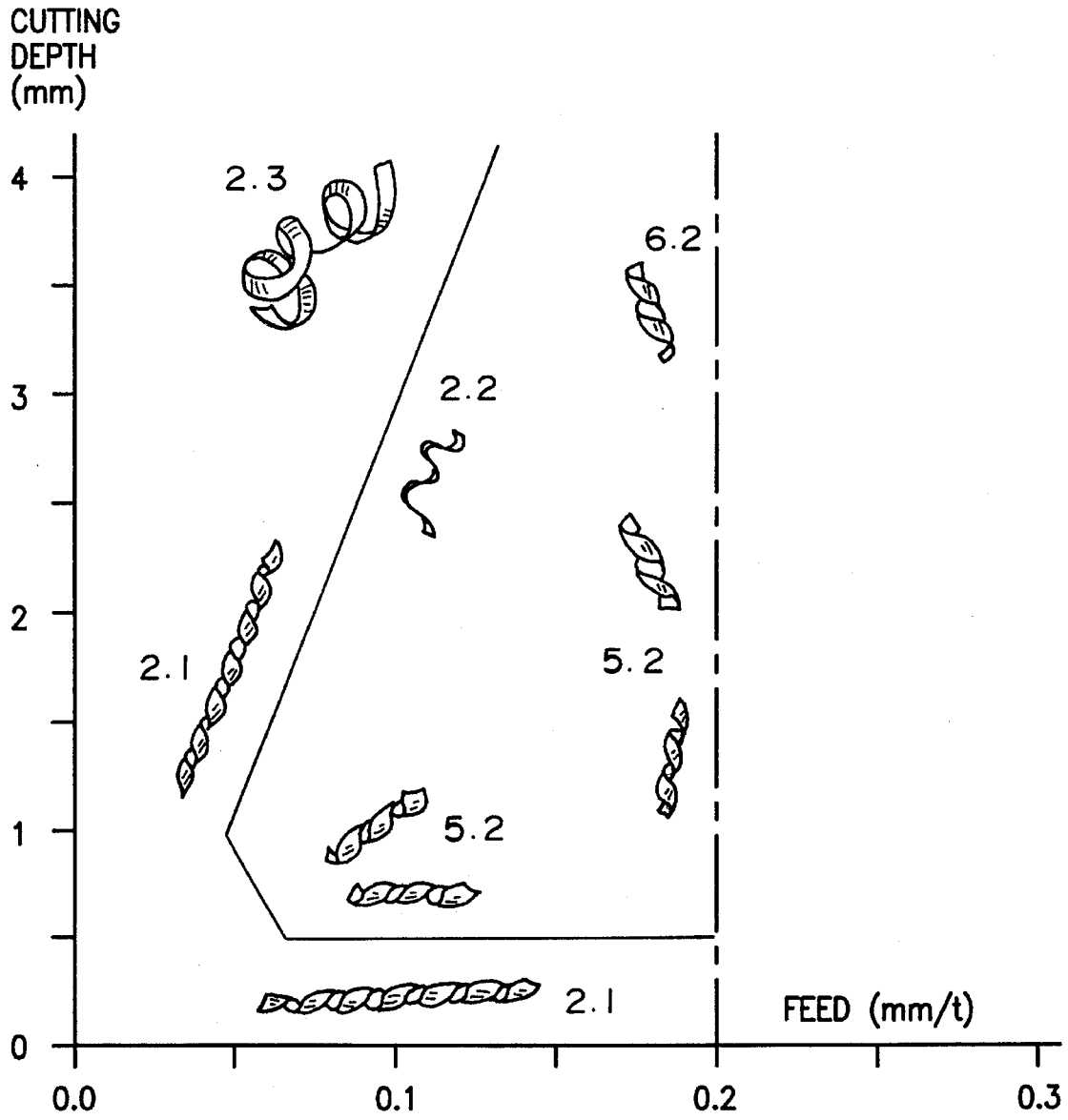
FIG. 8 represents a diagram showing diagrammatically the shape of chips as a function of the feed of the tool and of the machining cutting depth-for a steel C2 according to the invention.

In fact, the steel C1, because of its composition, does not contain enough of the so-called malleable oxides of the anorthite, gehlenite and pseudowollastonite type due to the lack of calcium in the metal. Furthermore, we observe in the diagrams of FIG. 8 that the steel C2 according to the invention has a fragmentation zone markedly greater than that of the reference steel A and even close to that of the reference steel C which is a resulfurized ferritic steel.

As regards the steels having intermediate sulfur contents, lying between 0.05% and 0.15%, we find that the steels according to the invention have a machinability comparable to that of the resulfurized steels while still having better corrosion resistance.

In another application, it has turned out that the presence of so-called malleable oxides in a ferritic steel had particular advantages.

The reason for this is that the malleable oxides are capable of deforming in the rolling direction, whereas the hard oxides which they replace have a granular shape.

In the field of wire-drawing of small-diameter ferritic-steel wires, the chosen inclusions according to the invention consequently reduce the rate of breakage of the drawn wire.

In the field of the manufacture of steel wool by the shaving of wire made of ferritic stainless steels, the hard inclusions which rapidly wear out the shaving tools also cause, because of their granular shape, significant breakages impairing the quality of the steel wool.

According to the invention, the ferritic stainless steels in the form of wires including malleable inclusions, subjected to shaving, exhibit properties which ensure the formation of strands of steel wool of greater average length and allow shaving with much less residual wire, which makes it possible to save on material.

In another field of application, for example in polishing operations, the hard inclusions are embedded in the ferritic steel and cause surface grooves.

The ferritic steel according to the invention, comprising malleable inclusions, may be polished much more easily in order to obtain an improved polished surface finish.

We claim:

1. Stainless steel of ferritic structure and with improved machinability which can be used, especially, in the field of screw-machining, which includes, in its composition:

$C \leqq 0.17\%$ $Si \leqq 2.0\%$

Mn'2.0%

Cr [11–20] %

$Ni < 1\%$ $S \geqq 0.55$ %

$Ca \geqq 30 \times 10^{-4}\%$ $O \geqq 70 \times 10^{-4}\%$ the Ca/O ratio, between the calcium content and the oxygen content, being given by $0.2 \leqq Ca/O \leqq 0.6$.

2. Steel of ferritic structure as claimed in claim 1, wherein it is composed of:

$C \leqq 0.12\%$ $Si \leqq 2.0\%$ $Mn \leqq 2.0\%$

Cr [15–19] %

$Ni < 1\%$ $S \leqq 0.55\%$ $Ca \geqq 35 \times 10^{-4}\%$ $O \geqq 70 \times 10^{-4}\%$ the Ca/O ratio, between the calcium content and the oxygen content, satisfying the relationship: $0.35 \leqq Ca/O \leqq 0.6$.

3. Stainless steel of ferritic structure as claimed in claim 1, wherein it is composed of:

$C \leqq 0.08\%$ $Si \leqq 2.0\%$ $Mn \leqq 2.0\%$

Cr [15–19] %

$Ni < 1\%$ $S \leqq 0.55\%$ $Ca \geqq 35 \times 10^{-4}\%$ $O \geqq 70 \times 10^{-4}\%$ the Ca/O ratio, between the calcium content and the oxygen content, satisfying the relationship $0.35 \leqq Ca/O \leqq 0.6$.

4. Steel of ferritic structure as claimed in claim 1, wherein it includes less than 0.035% of sulfur.

5. Steel of ferritic structure as claimed in claim 1, wherein it includes between 0.15% and 0.45% of sulfur.

6. Steel of ferritic structure as claimed in claim 1, wherein it includes between 0.05% and 0.15% of sulfur.

7. Steel of ferritic structure as claimed in claim 1, wherein it furthermore includes less than 3% of molybdenum.

8. Steel of ferritic structure as claimed in claim 1, wherein it contains silica/alumina/calcium-oxide inclusions of the anorthite and/or pseudowollastonite and/or gehlenite type.

* * * * *